United States Patent [19]

Rudy

[11] 3,971,656

[45] July 27, 1976

[54] SPINODAL CARBONITRIDE ALLOYS FOR TOOL AND WEAR APPLICATIONS

[76] Inventor: Erwin Rudy, 15750 NW. Oak Hill Drive, Beaverton, Oreg. 97005

[22] Filed: May 29, 1974

[21] Appl. No.: 473,501

Related U.S. Application Data

[63] Continuation-in-part of Ser. No. 370,865, June 18, 1973, abandoned.

[52] U.S. Cl. ..... 75/203; 29/182.5; 29/182.7; 75/204; 75/205; 75/175.5

[51] Int. Cl.[2] ..... C22C 1/05; C22C 29/00

[58] Field of Search ..... 29/182.5, 182.7, 182.8; 75/203, 204, 205, 175.5, 201

[56] References Cited

UNITED STATES PATENTS

| | | | |
|---|---|---|---|
| 3,479,155 | 11/1969 | Rudy | 29/182.1 X |
| 3,671,201 | 6/1972 | Bergna | 29/182.5 |
| 3,703,368 | 11/1972 | Rudy | 75/175.5 |
| 3,741,733 | 6/1973 | Kieffer | 75/204 X |

FOREIGN PATENTS OR APPLICATIONS 2,219,409 11/1972 Germany

OTHER PUBLICATIONS

Chem. Abs. No. 76:171224k, vol. 76 p. 179 1972.

*Primary Examiner*—Richard E. Schafer
*Attorney, Agent, or Firm*—Ronald W. Reagin

[57] ABSTRACT

A composition of material is disclosed which is an alloy of a sintered carbonitride and a binder metal. The carbonitride alloys are based on selected compositions located within the spinodal range of the systems and having titanium and group VI metals M as its base metals and has a gross composition falling within the area ABDE of Figure 1. The binder is selected from metals of the iron group and metals of the group VI refractory transition metals and comprises between 5 and 45 weight percent of the composition.

14 Claims, 14 Drawing Figures

α" T α'

α" T α'

SPINODAL CARBONITRIDE ALLOYS FOR TOOL AND WEAR APPLICATIONS

This application is a Continuation-in-Part of application Ser. No. 370,865, filed: June 18, 1973 now abandoned.

The present invention relates to improved cemented carbonitride alloys and more particularly to improved carbonitride alloys based on selected compositions located within the spinodal range of the base alloy systems titanium-molybdenum-carbon-nitrogen and titanium-tungsten-carbon-nitrogen.

Early efforts to incorporate the attractive properties of group IV transition metal nitrides and their alloys with the isomorphous, carbides in machine tool alloys were not successful. Wetting of these nitrides and carbonitrides by iron metal alloy binders, principally nickel and cobalt, generally was found to be poor, and the strength levels attained in the sintered composites was too low for the intended use. However, a study published by R. Kieffer, P. Ettmayer and M. Freudhofmeier, Metall 25, 1971, p.1335, showed improved strength properties by using nickel-molybdenum binders for titanium carbonitride solid solutions. In the cited study, a strength maximum was reported near a carbonitride composition with 80 mole percent titanium nitride. The materials in the reported study required unusually high sintering temperatures of up to 1600°C, and sintering times of up to 9 hours, which were attributed to poor binder wettability. In order to prevent nitrogen losses, sintering of the composites is carried out under a partial atmosphere of nitrogen.

The high sintering temperatures required for these cemented composites cause serious grain growth and fabricability problems, and special precautions must be taken to prevent distortion of the parts and to minimize interaction with the sintering substrates. Other disadvantages of these cemented titanium carbonitrides, which they share with titanium carbidemolybdenum-nickel tool alloys such as are disclosed in U.S. Pat. No. 2,967,349, is their thermal deformation and notching tendency when used as a machine tool for cutting steel, and the fact that only limited alloying can be accomplished without traversing the carbonitride phase boundaries and incurring rapid deterioration of the strength properties of the composite through binder embrittlement by excess molybdenum.

It is accordingly an object of the present invention to provide an improved composition of material based on carbonitride alloys which exhibit superior strength characteristics and improved fabricability.

It is another object of the present invention to provide an improved hard carbonitride alloy through use of a novel spinodal reaction occurring in selected composition areas of quaternary and higher order carbonitride alloys.

It is another object of the present invention to provide such alloys which are stable under vacuum sintering conditions in the presence of iron-group metal binder alloys.

It is a further object of the present invention to provide such alloys, in which the spinodal reaction in the carbonitride alloy, combined with diffusional reactions taking place in the liquid binder phase during sintering, result in a unique microstructure, in which the carbonitride forms a coherent and low stress interface with a substantially nitrogen-free carbide alloy, and the latter carbide alloy forms the main interface with the iron metal alloy binder.

Briefly stated, and in accordance with the present invention, a cemented carbonitride alloy is provided in which the carbonitride component has a gross composition expressed by the equation $(Ti_xM_y)\ (C_uN_v)_z$, where M represents either molybdenum or tungsten, the values for $u$, $v$, $x$, and $y$ are defined by the area ABDE of the attached FIG. 1 (which is discussed in detail below), and the value of $z$, the stoichiometry parameter, is between 0.80 and 1.07. The binder phase of the alloy is selected from the iron group metals and metals from the group VI refractory transition metals and comprises between 5 and 45 percent by weight of the composition.

In the preferred range of the present invention, the carbonitride component has a gross composition in which the values of $u$, $v$, $x$ and $y$ are defined by the area AB′ C′ D′ E′ of FIG. 1. The binder phase of the alloy is selected from the group consisting of cobalt and nickel and comprises between 8 and 25 percent by weight of the composition.

For a complete understanding of the invention together with an appreciation of its other objects and advantages, please see the following detailed description of the attached drawings, in which.

Figure 6:
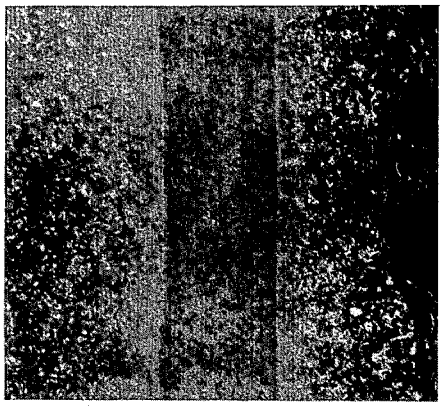
FIG. 6 is a photograph, magnified 80 times, of the same composition as FIG. 5, but which has been subjected to additional nitriding and heat treatment.
Figures 7A, 7B, 7C:
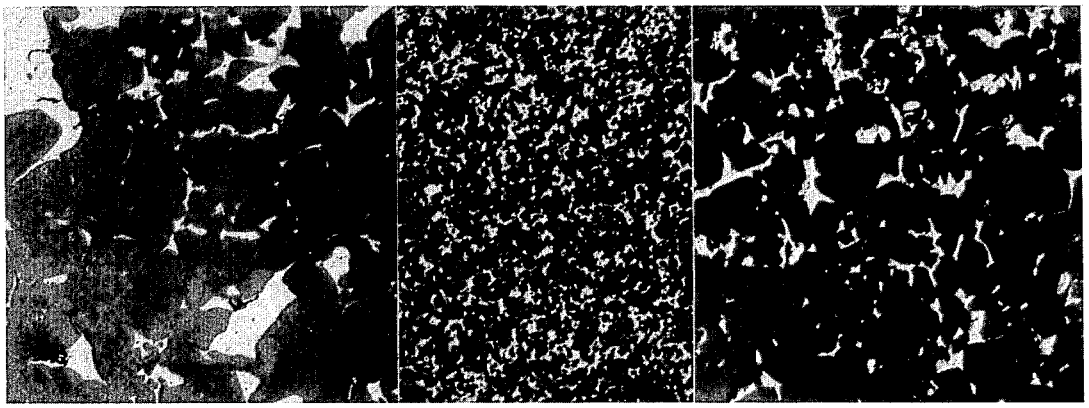
Figure 8:
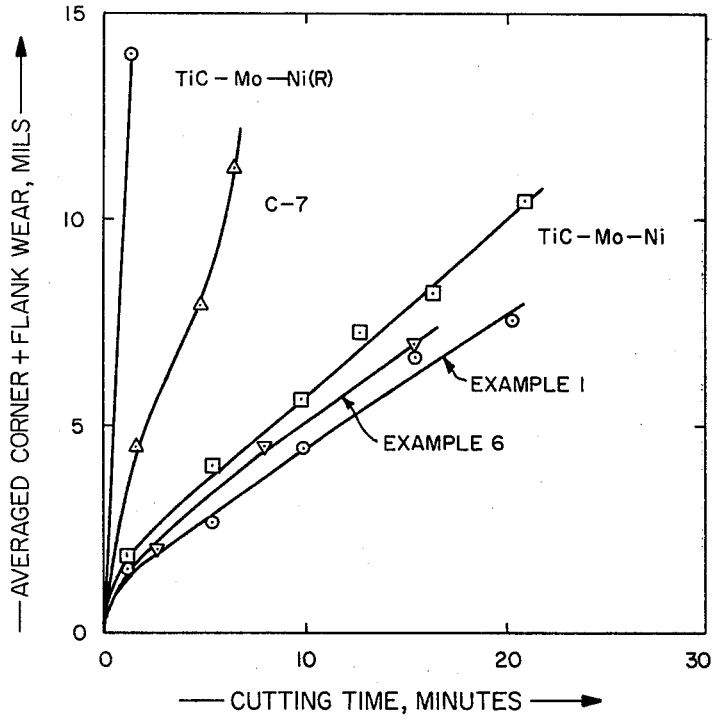
Figure 9:
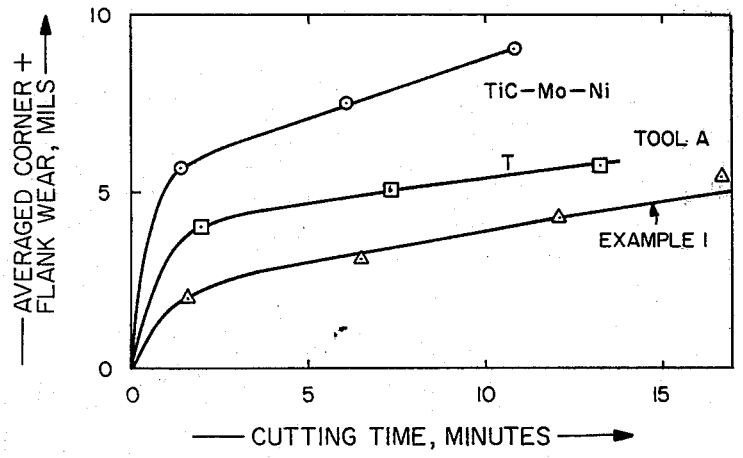
Figure 10:
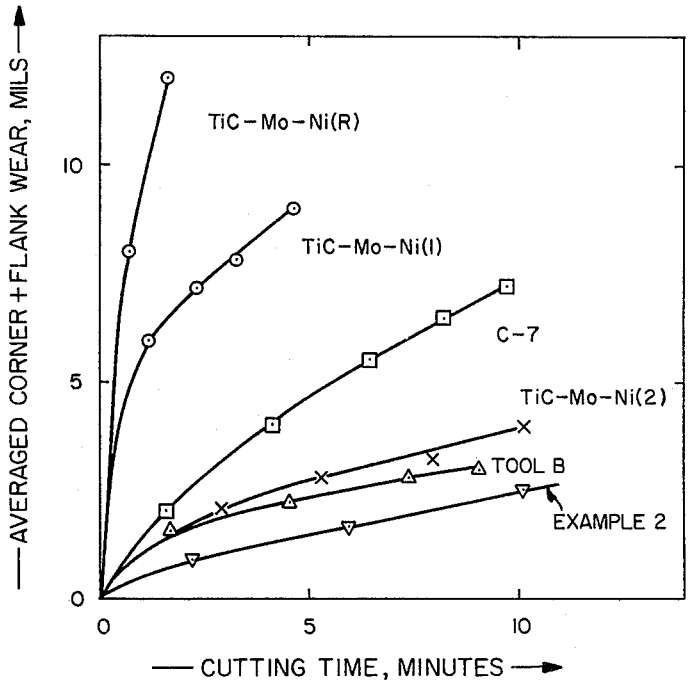
Figure 11:
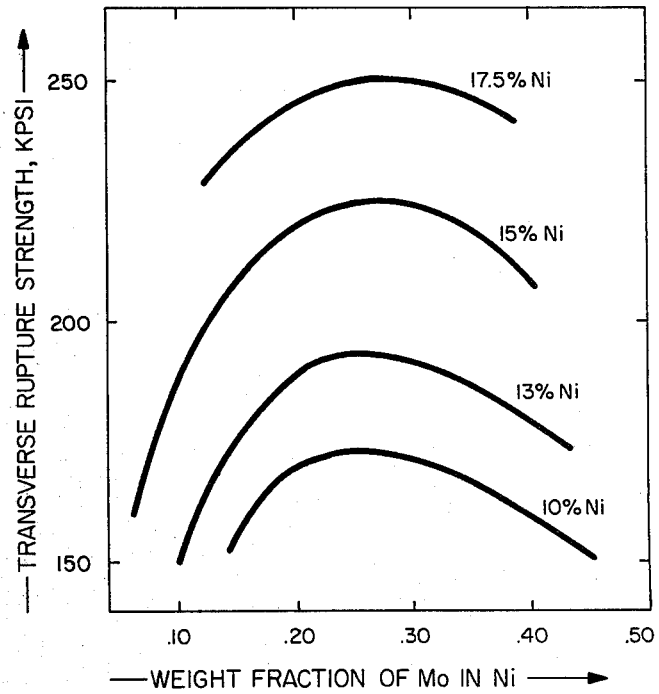
Figure 12:
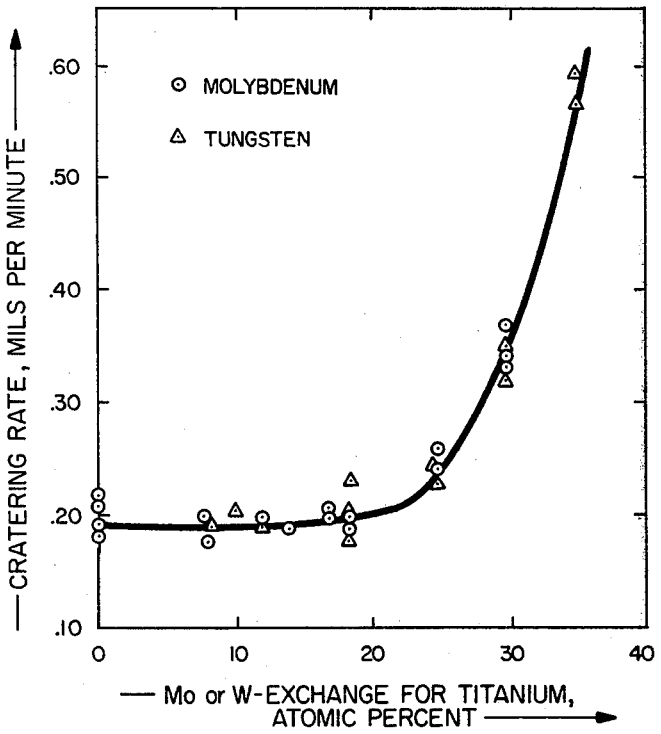

FIGS. 7*a*, 7*b* and 7*c* are photographs, magnified 1000 times, of portions of FIG. 6;

FIGS. 8, 9 and 10 are wear curves comparing the wear of tools according to the present invention, and according to the prior art when subject to identical test conditions;

FIG. 11 is a graphical representation of the bending strength of tools in accordance with the present invention as a function of binder content of the tool; and FIG. 12 shows the cratering rate of tools in accordance with the present invention as a function of molybdenum and tungsten exchange in the carbonitride phase of the alloy.

Although the cemented carbonitride alloys can comprise a large number of different alloying elements added in proportions determined by the phase equilibrium of the respective alloy systems, the preferred embodiments of the cemented carbonitrides of this invention are based on the systems Ti-Mo-C-N and Ti-W-C-N.

The gross compositions of the carbonitride component used in the fabrication of the carbonitride-binder metal composites of the invention can be expressed either in atomic percent of the constituent elements, for examples as $Ti_aM_bC_cN_d(a+b+c+d=100)$, where M represents either molybdenum or tungsten, and $a$,$b$,$c$, and $d$ are, respectively, the atomic percent of titanium, molybdenum or tungsten, carbon, and nitrogen present in the alloy; or as relative mole fractions of metal and interstitial elements in the form $(Ti_xM_y)(C_uN_v)_z$, $(x+y=1)$; $(u+v=1)$, whereby $x$ and $y$ are, respectively, the relative mole fractions (metal exchange) of titanium and either molybdenum or tungsten; $u$ and $v$ are, respectively, the relative mole fractions of carbon and nitrogen; and the stoichiometry parameter $z$ measures the combined number of gramatoms of carbon and nitrogen per gramatom metal (Ti + M).

It is noted that $100.^y$ defines mole percent molybdenum or tungsten exchange for titanium in $(Ti_xMy)(C_uN_v)_z$, $100.^x$ defines mole percent titanium exchange, $100.^u$ mole percent carbon exchange, and $100.^v$ mole percent nitrogen exchange. The two sets of composition variables are readily interconverted by the relations:

$$a = 100 \cdot \frac{x}{1-z}; \quad b = 100 \cdot \frac{y}{1+z}; \quad c = 100 \cdot \frac{u}{1+z}; \quad d = 100 \cdot \frac{v}{1+z}$$

$$x = \frac{a}{a+b}; \quad y = \frac{b}{a+b}; \quad u = \frac{c}{c+d}; \quad v = \frac{d}{c+d}; \quad z = \frac{c+d}{a+b}$$

The latter method of defining the overall composition of the carbonitride component, the designation $(Ti_xM_y)(C_uN_v)_z$, is particularly useful in describing the concentration spaces of interstitial alloys and is used throughout the remainder of this specification. Because molybdenum and tungsten are in many cases completely interchangeable and unless specifically noted otherwise, the term M is used to designate a metal component comprising other molybdenum or tungsten, or any ratio of the two metals.

Figure 1:
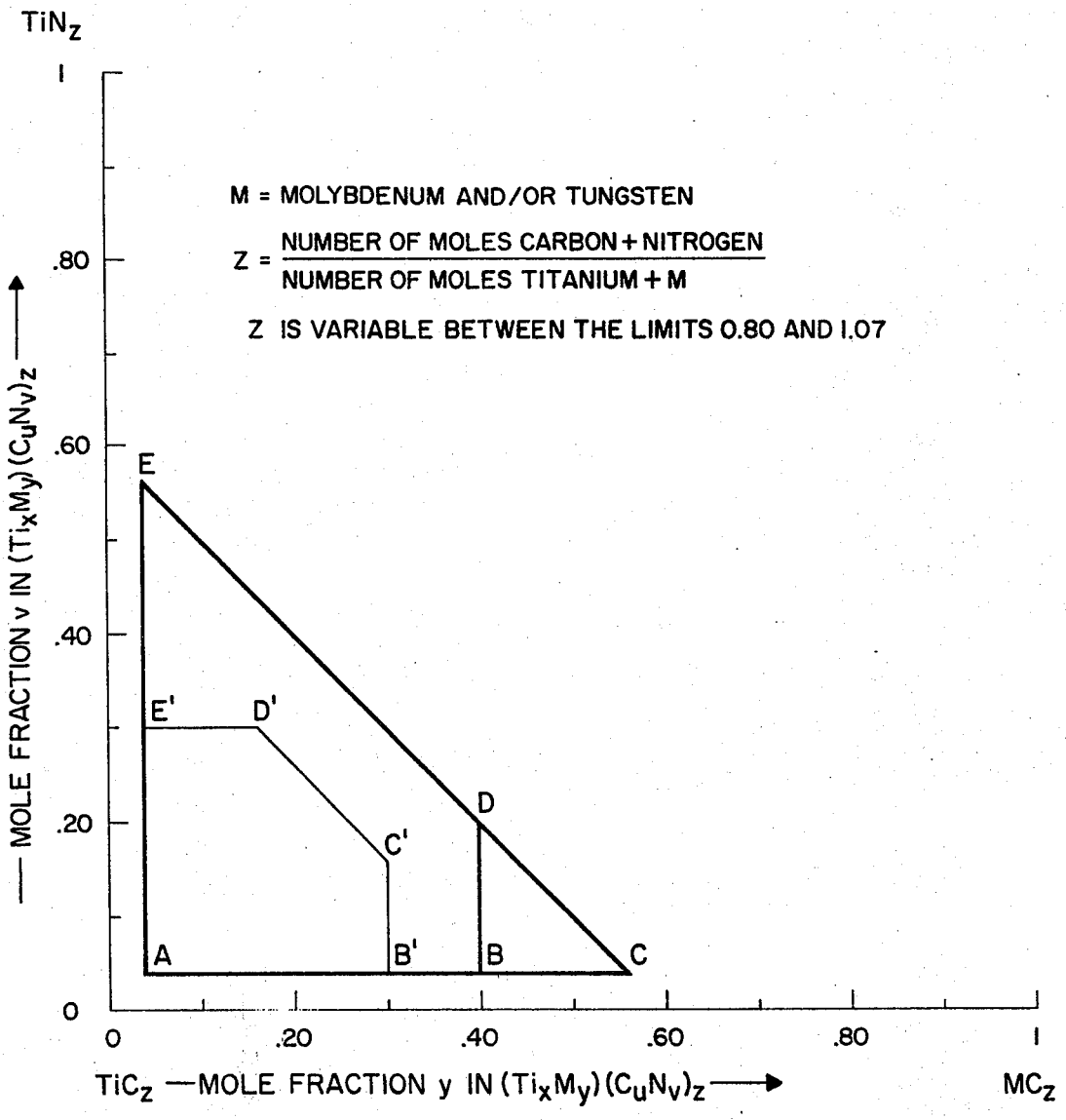
FIG. 1 is a graphical representatiion of the carbonitride phase of the present invention.

FIG. 1 is a graphical representation of the gross composition of the carbonitride solid solutions $(Ti_xM_y)(C_uN_v)_z$ used as input material in the fabrication of the alloy compositions of the present invention. In the chosen notation, the ordinate in FIG. 1 is the mole fraction v, and is also the composition line $Ti(C,N)_z$ while the abscissa corresponds to $y$, and is the composition line $(Ti,M)C_z$. Both concentration axes also defines $u$ and $x$, since $x + y = 1$ and $u + v = 1$.

The gross carbonitride compositions of the tool alloys in accordance with the present invention generally fall within the composition area bounded by ABDE, but preferably within the more confined area AB'C'λ D'E' in FIG. 1. Carbonitride alloys located outside the area AB'C'D'E', but inside ABDE, provide alloys of lesser quality when employed as cutting tools, but may have other useful applications. In the chosen notation, composition A corresponds to $(Ti_{.96}M_{.04})(C_{.96}N_{.04})_z$, composition B to $(Ti_{.60}M_{.40})(C_{.96}N_{.04})_z$, composition C to $(Ti_{.44}M_{.56})(C_{.96}N_{.04})_z$, composition D to $(Ti_{.60}M_{.40})(C_{.80}N_{.20})_z$, composition E to $(Ti_{.96}M_{.04})(C_{.44}N_{.56})_z$, composition B' to $(Ti_{.70}M_{.30})(C_{.96}N_{.04})_z$, composition C' to $(Ti_{.70}M_{.30})(C_{.84}N_{.16})_z$, composition D' to $(Ti_{.84}M_{.16})(C_{.70}N_{.30})_z$, and composition E' to $(Ti_{.96}M_{.04})(C_{.70}N_{.30})_z$. The stoichiometry parameter $z$ is in all cases variable between 0.80 and 1.07.

Figure 2:
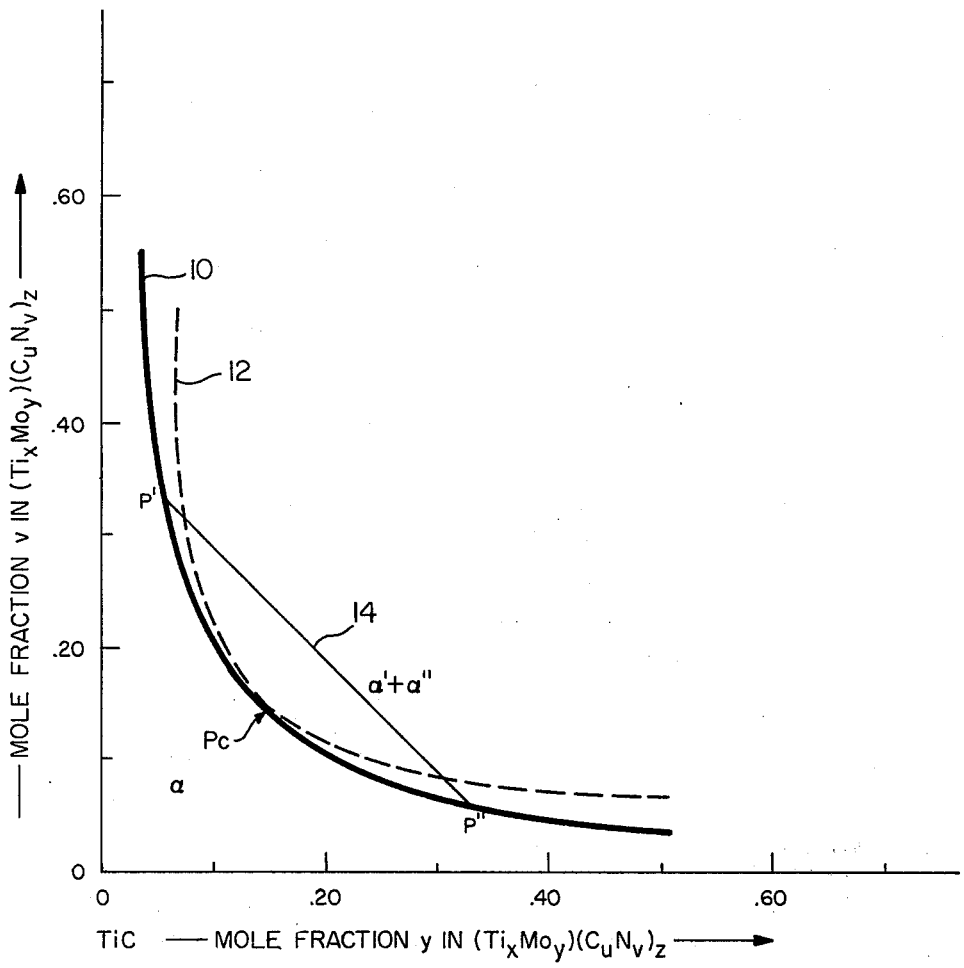
FIG. 2 is a partial phase diagram for the Ti-Mo-C-N system at 1450°C and illustrates the disposition of the miscibility gap and spinodal boundary of the system upon which the present invention is based.

The alloying principles underlying the materials of the invention are demonstrated by FIG. 2, which shows the partial phase diagram for the Ti-Mo-C-N system at 1450°C, with the value of $z$ being approximately 0.90 to 0.98. The ordinate and the abscissa of FIG. 2 are the same as in FIG. 1. In FIG. 2, the range denoted $\alpha$ designates the homogeneous solid solution (Ti,Mo)(C,N)

and the range denoted $\alpha' + \alpha''$, which is within the miscibility gap of the diagram, designates the composition area within which single phase solid solutions are unstable at the indicated temperature. The solid line curve 10 designates the phase boundary of the system at this temperature. The point $P_c$ marks the critical point of the system. The broken line curve 12 designates the spinodal which defines the boundary within which carbonitride solid solutions may decompose spontaneously. For higher temperatures, the size of the miscibility gap shrinks, and these curves 10 and 12 and the critical point $P_c$ shift upward and to the right, further away from the TiC corner, or origin of the graph of FIG. 2.

From the depicted phase diagram, it will be appreciated that equivalent reactions do not occur in either of the boundary systems Ti(C,N), which is represented by the ordinate of FIG. 2, or (Ti,Mo)C, which is represented by the abscissa of FIG. 2, and that special, and defined, concentration relationship between the base metals and the interstitial elements carbon and nitrogen, as well as defined temperature relationships, have to be maintained to benefit from these special phase relationships. It further can be seen from the diagram that alloys located within the range $\alpha' + \alpha''$ consists of two phases (for example, P' and P'', which are related to each other and are shown connected by the line 14). The composition at the point P' which represents the $\alpha'$ phase, contains most of the nitrogen contained in the alloy but very little molybdenum. The second phase, or $\alpha''$ phase, represented at the point P'', contains most of the molybdenum in the alloy but only little nitrogen.

In conjunction with the description of the alloys of the invention, consideration of several properties of the phases coexisting within the two-phase field $\alpha' + \alpha''$ is important. First, within the composition range of the alloys of this invention, the lattice parameters of the $\alpha'$ phase are nearly identical with that of the $\alpha''$ phase, and it is thus possible to have a low stress, coherent interface $\alpha'/\alpha''$ in the $\alpha' + \alpha''$ decomposition structure. This is important since considerable lattice mismatch results in stress centers, which act as crack nucleation centers and result in lower strength and fatigue life of the composite. Secondly, the two-phase mixture has a considerably lower nitrogen decomposition pressure than the homogeneous solid solution of corresponding gross composition, and the decomposition pressure of the $\alpha''$ phase furthermore decreases rapidly with increasing nitrogen defect of the solid solutions. Thirdly, because the $\alpha''$ phase has a much higher wettability and solubility in the iron metal alloy binder than does the $\alpha'$ phase, the $\alpha''$ phase is transported preferentially and physically encloses the $\alpha'$ carbonitride phase during the liquid phase sintering operation. Because the carbonitride phase is not in extensive contact with the iron metal binder, decomposition of the carbonitride phase is minimized to such an extent that the alloys of the invention can be sintered under high vacuum without degradation of the composite through loss of nitrogen. It will be appreciated by those skilled in the art that sintering titanium-rich alloys under high vacuum is a prerequisite to maintaining freedom of contamination and porosity and thus for obtaining sintered parts with good surface and bulk quality. Since the sintering characteristics are to a large degree controlled by the better wetting $\alpha''$ or carbide phase, the sintering temperatures for the composites of the invention are essentially the same as for cemented carbides and considerably lower than those for cemented group IV metal carbonitrides.

Phase relationships similar to those shown for the Ti-Mo-C-N system have been observed in the system Ti-W-C-N and in corresponding systems, in which vanadium, zirconium, and hafnium take the place of titanium. Substitution of group V metals (such as vanadium, niobium and tantalum) and chromium, when used in replacement for molybdenum and tungsten have the general effect of diminishing the size of the miscibility gap and lowering the nitrogen decomposition pressures, while vanadium in replacement for titanium leaves the size of the miscibility gap essentially unchanged but increases the nitrogen decomposition pressure. It is thus possible, without change of the principal phase equilibrium characteristics, to considerably vary composition, and thus properties, of the composites and adapt them to specific requirements. Such possible exchanges, and their effects, are discussed in more detail below.

It is seen from a comparison of FIG. 1 and FIG. 2 that the point A of FIG. 1 is located outside the miscibility gap of the carbonitride solid solution. The particular limits were chosen because it was found that the beneficial effects of the spontaneous spinodal decomposition reaction were retained even though only a portion of the alloy corresponded to mixtures located within the $\alpha' + \alpha''$ range. This behavior was particularly noted for cemented carbonitride alloys prepared from incompletely nitrided mixtures containing titanium carbide. The microstructures of such composites contained hard phase grains with central cores consisting of nearly unchanged TiC, secondary cores with a gradated increase of nitrogen content, and an outermost, separate, core enclosure of almost nitrogen-free carbide alloy.

The carbonitride-metal composites of the invention may be fabricated by several different powder metallurgy techniques. A typical fabrication procedure is as follows: A mixture of carbonitride alloy and binder alloy powders in the desired proportions are ball-milled in stainless steel jars for 4 to 5 days, using tungsten carbide-cobalt alloy balls and naphta or benzene as milling fluid. Depending on the powder density, 3 to 5 weight percent pressing lubricant, usually paraffine, is added in solution with a suitable solvent such as benzene. The paraffine solvent is then evaporated and the dry powder mixture compacted into the desired shapes at pressures varying between 5 and 10 tons per square inch. The pressing lubricant is then removed by gradual heating to temperatures up to 400°C under vacuum. The compacts, which are stacked on suitable supports such as graphite, are first degassed for 15 to 20 minutes at 1000° to 1200°C, and then sintered for 1-½ hours between 1410° and 1440°C under vacuum. For the evaluation of the alloys of the invention as machine tools, the sintered parts are ground on diamond wheels to the desired tool geometry.

Th carbonitride alloys used in the preparation of the composites of the invention can be prepared in different ways. The preferred method hereinafter called Method 1, consists of in situ nitriding of suitable mixtures of carbides and refractory metals at temperatures varying between 1400° and 1800°C, depending upon the composition, under a nitrogen atmosphere. In a second method of preparation, hereafter called Method 2, separately prepared master alloys of nitrides and carbides are mixed in the desired proportions and homogenized by exposure to high temperatures (1700° to 2300°C) under an inert atmosphere, preferably under simultaneous applications of pressure to aid grain contact and diffusion. The heat treated mixture is then crushed and comminuted to the desired grain size for use in the tool alloy batching.

Method 1 is generally preferable, because the chance for oxygen contamination is less and equilibration of the alloys is usually easier to accomplish. In spite of precautions taken in the preparation and storage of nitrides and in the fabrication of the carbonitride master alloys, sintering temperatures for composites using carbonitride master alloys prepared according to Method 2 were generally noted to be 40° to 70°C higher than for alloys with identical gross compositions, but which were prepared from in situ nitrided powders according to Method 1.

Typical laboratory fabrication procedures for a carbonitride master alloy with a molar ratio of titanium to molybdenum of 4:1 were as follows:

METHOD 1

Titanium monocarbide and molybdenum metal powder in the molar ratio of 4:1 are intimately blended and the powder mixture isostatically pressed. The compacts are then loaded into a graphite container and heated under vacuum to a temperature of about 1100°C until no further degassing is noticed. Nitrogen is then admitted to the furnace chamber and the temperature gradually raised to 1450°C. After the initial reaction is passed, the temperature is gradually raised to the range of 1500° to 1550°C and the nitriding continued for 3 to 10 hours. The nitrided product is then cooled to room temperature, crushed, and milled to a grain size less than 75 micrometers. The nitrided alloy typically contains about 2.30 to 2.40 weight percent nitrogen corresponding to a gross composition $(Ti_{.80}Mo_{.20})(C_{.87}N_{.13})_{.91}$ and the X-ray diffraction pattern shows the two, almost coinciding, patterns of the $\alpha'$ and $\alpha''$ phases, and sometimes traces of unconverted TiC.

METHOD 2

Titanium nitride and titanium monocarbide powders in the molar ratio 4:6 are intimately blended and the mixture hotpressed for 25 minutes at 2300°C. To aid diffusion, 0.2 to 1 percent by weight of an iron group metal (iron, cobalt or nickel) can be added to the mixture prior to compaction. The hot pressed pieces are then heated to 1500°C under vacuum for degassing, and then homogenized for 10 hours at 2200°C under nitrogen of ambient pressure. The homogenized material is then crushed and ball-milled to a grain size smaller than 75 micrometers.

The carbide component with a gross composition $(Ti_{.6}Mo_{.4})C_z$, in which $z$ is approximately 0.90, is prepared by hot-pressing mixtures of TiC, $Mo_2C$, and carbon, and subsequently homogenizing the compacts for 8 hours at 2000°C under vacuum. The compacts are then crushed and milled to a grain size less than 75 micrometers.

The carbonitride master alloy of the indicated gross composition is obtained by mixing equimolar masses of the just described titanium carbonitride and titanium-molybdenum monocarbide alloy powders and reacting the compacted powder mixtures for 10 hours at 1600°C under a nitrogen atmosphere. Different gross alloy compositions are obtained by variations of the mixture ratios of the two ingredient powders, or by admixing other carbonitride and carbide solid solutions.

Figure 3:
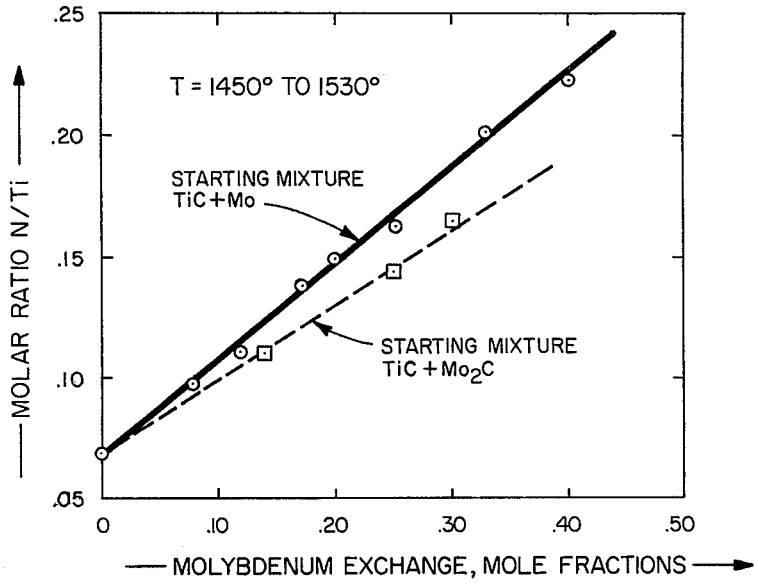
FIGS. 3 and 4 are graphical representations of typical nitrogen contents of certain alloys after nitriding under specified conditions.
Figure 4:
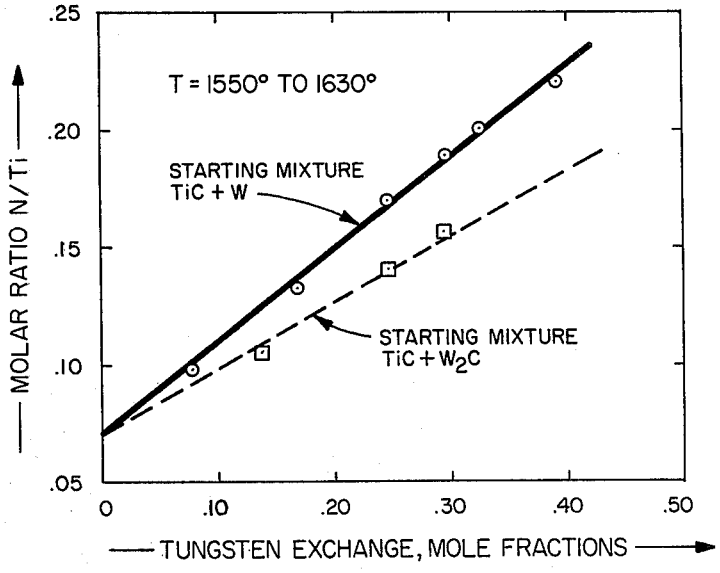

The in situ nitriding method (Method 1) is quite flexible and alloys with varying nitrogen contents and degree of reaction can be fabricated by different choices of input materials, nitrogen pressure, and duration and temperature of the nitriding operation. Typical nitrogen contents of in situ nitrided alloys based on the system Ti-Mo-C-N and Ti-W-C-N are depicted in FIGS. 3 and 4, respectively. The abscissae in these figures are the molybdenum and tungsten exchanges in the alloys, which is the mole fraction $y$ in the notation $(Ti_xM_y)(C_uN_v)_z$, while the ordinates denote the molar ratio of nitrogen to titanium in the mixtures after nitriding for 4 hours at the indicated temperatures and a nitrogen pressure of one atmosphere. The methods of fabrication of in situ nitrided mixtures containing other transition metals, such as zirconium, hafnium, vanadium, niobium, tantalum and chromium, is generally similar to the method described for the system Ti-Mo-C-N and Ti-W-C-N.

Those skilled in the art can devise other methods of making the compositions of the invention. For example, carbonitride alloys with high nitrogen contents can be fabricated by the in situ nitriding technique (Method 1) by additions of group IV and V metals to the initial mixture. Small additions of other metals to the binder phase, in combination with different sintering conditions, may significantly change the characteristics of the composites of the invention and improve performance for particular applications. Similarly, certain nitriding conditions, such as nitriding of pure TiC for example, may lead to the formation of excess carbon. Such excess carbon has to be compensated for by addition of an extra amount of metal to the binder phase in the preparation of the tool alloy batch. The effective gross carbonitride composition in such an instance is then determined from the composition of the excess carbon containing alloy and the amount of addition metal necessary to eliminate the free carbon. Tools A, B and C, described in the tests below, are examples of tools so formed.

Aside from the routine fabrication variables, choice of carbonitride ingredients and binder alloy for a given gross composition of the composite, as well as milling and sintering procedures, strongly influence microstructure and phase constituents and, as a result, the properties of the sintered compacts. Although no generally valid comparisons between the relative merits of different compositions can be made because of varying requirements for different applications, extensive evaluation of the performance of the composites of the invention as machine tools for low alloy steels have shown, that the best alloy combinations are those in which a substantial fraction of the carbonitride mixture falls within the spinodal range of the miscibility gap. Such alloys also proved extremely stable towards grain growth, and strength and performance were quite insensitive to variations in fabrication conditions.

Figure 5:
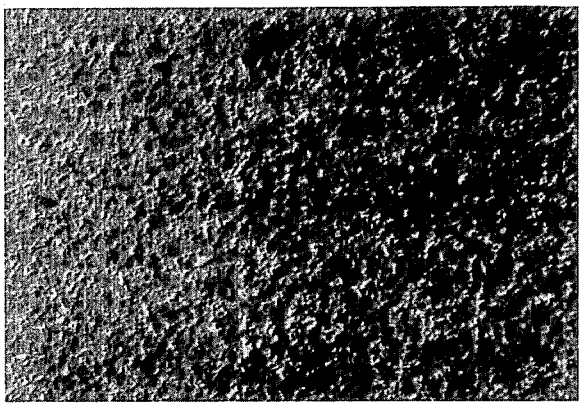
FIG. 5 is a photograph, magnified 1000 times, of a composition of material in accordance with the present invention.

The stability towards grain growth of the compositions of the present invention are illustrated by FIGS. 5 through 7, which are enlarged photographs of an alloy in accordance with the invention which was subjected to the below described conditions to show the grain growth stability of the composition as contrasted to the grain growth stability of either its $\alpha'$ phase component or $\alpha''$phase component.

FIG. 5 which is a photograph magnified 1000 times, shows the microstructure of a substoichiometric alloy $(Ti_{.81}Mo_{.19})(C_{.82}N_{.18})_{.90}$ and 10 percent by weight nickel after sintering for 1 hour at 1400°c under vacuum. FIG. 6 is a photograph of the same alloy magnified 80 times after additional nitriding, and further exposure for 64 hours at 1470°C. The purpose of this additional nitriding treatment was to induce a diffusion reaction to cause the formation of a titanium-rich layer near the sample surface, corresponding to the phase boundary $\alpha'$, and a molybdenum-rich inner zone, corresponding to the $\alpha''$ phase boundary. The transition zone T, visible as a band near the center of the micrograph in FIG. 6, corresponds to the spinodal range in the phase diagram section shown in FIG. 2. FIGS. 7*a*, 7*b* and 7*c* shows the different zones in FIG. 6 at the higher magnification of 1000. FIG. 7*a* shows the $\alpha''$ phase, FIG. 7*b* shows the transition Zone T and FIG. 7*c* shows the $\alpha''$ phase. It is readily apparent from a comparison of these photographs that the $\alpha'$ and $\alpha''$ phases separately, and in the presence of nickel binder, show substantial grain growth when heat treated for prolonged periods of time, such as occur during sintering, while the grain size of the phase mixture remains practically unchanged by the same treatment.

The following tables and graphs show the performance of a large number of tools having different compositions within the range of the invention and also give comparison data for a number or prior art, carbide-based, tools which are designed for similar applications.

Five different test conditions were used. These are designated test condition A, test condition B, test condition C, test condition D, and test condition E. Unless otherwise noted, test conditions referred to in the tables were:

TEST CONDITION A (wear test)
4340 steel, $R_c$ 18 to 27; cutting speed, 1000 surface feet per minute; feed rate, .0101" per revolution; depth of cut, .050", no coolant. SNG 433 inserts.

TEST CONDITION B (wear test)
4340 steel, $R_c$ 32 to 34; cutting speed, 750 surface feet per minute; feed rate, .0101" per revolution; depth of cut, .060"; no coolant. SNG 433 inserts.

TEST CONDITION C (light roughing)
4340 steel, $R_c$ 18 to 27; cutting speed, 500 surface feet per minute; feed rate, .0203" per revolution, depth of cut, .125"; no coolant. SNG 433 inserts.

TEST CONDITION D (thermal deformation test)
4340 steel, $R_c$ 31 to 34; cutting speed, 1000 surface feet per minute; feed rate, .0101" per revolution, depth of cut, .050"' no coolant. SNG 433 inserts.

TEST CONDITION E (edge breakdown test)
4340 steel, $R_c$ 18 to 22; cutting speed, 500 surface feet per minute; depth of cut, .080"; stepwise increase of feed in increments of approximately .005" per revolution after ½ minute cutting passes until edge breakdown; no coolant. SNG 433 inserts.

The wearland was measured after suitable time intervals with the aid of a tool microscope. Plastic deformation and crater depth were measured on a metallograph.

To obtain a comparative performance evaluation of the composites of the invention, a cross section of representative tools from different manufacturers was also tested under identical conditions and the best performing tools selected as comparison standards. Tools from the C-5 and C-6 class of commercial steel cutting grades were omitted from the tabulation because of their extremely short life under the chosen cutting conditions. Among the commercial C-7 grade cemented carbides, the grade K7H manufactured by the Kennametal Company, 1000 Lloyd Avenue, Latrobe, Pennsylvania, performed best under the particular test conditions and was, therefore, selected as a comparison tool from this class of tooling materials.

The commercial tool materials identified as TiC-Mo-Ni in the tables and graphs belong to the C-8 class (finishing grades) of cemented carbide cutting tools and are based on alloys disclosed in the cited U.S. Pat. No. 2,967,349. Considerable differences in the cutting performance of tools with the same gross compositions, but manufactured by different companies, were encountered under selected cutting conditions. Where such significant performance differences were encountered, the tools from different manufacturers were identified by additional numbers, such as TiC-Mo-Ni (1) and TiC-Mo-Ni (2). The designation TiC-Mo-Ni (R) chosen in the tables and graphs pertains to a roughing grade based on the same alloy system, but with higher binder contents.

The following eight examples, which are representative of some of the compositions of the present invention, describe in detail eight specific compositions and the manner in which they were fabricated. In the first seven examples cited, the carbonitride alloy was prepared by in situ nitriding (Method 1) of the ingredient mixtures, while for the eighth example the carbonitride master alloy was prepared from separately fabricated nitrides and carbides according to Method 2.

EXAMPLE 1

A powder blend consisting of 83.75 weight percent carbonitride alloy with a gross composition $(Ti_{.82}Mo_{.18})(C_{.87}N_{.13})_{.92}$, 13 weight percent nickel, and 3.25 weight percent molybdenum was processed in the manner described above and the compacts sintered for 1 hour and 25 minutes at 1425°C under a vacuum of $10^{-5}$ torr. Linear shrinkage of the compact during sintering was 17 percent. The structure of the sintered composite consisted of three discernible phases, $\alpha'$, $\alpha''$, and binder, and the average grain size of the hard phases was approximately 2 micrometers. The measured hardness on the Rockwell A scale was 93.9 and the bending strength 207 kpsi (thousand pounds per square inch).

EXAMPLE 2

A powder blend consisting of 81.70 weight percent of a carbonitride alloy with a gross composition of $(Ti_{.80}Mo_{.20})(C_{.86}N_{.14})C_{.91}$, 15 weight percent nickel, $)(C_{3.30}$ weight percent .96was in the manner described before and sintered for 1 hour and 20 minutes at 1415°C under a vacuum of $10^{-5}$ torr. The linear shrinkage of the part during sintering was 16.8 percent. The microstructure of the composite was similar to that of example 1 and the measured hardness and bending strength were, respectively, $R_A = 92.9$ and 220 kpsi.

EXAMPLE 3

A powder blend consisting of 70.74 weight percent of nitrided TiC corresponding to a gross carbonitride composition $Ti(C_{.935}N_{.065})_{1.07}$, 18.26 weight percent molybdenum, and 11 weight percent nickel was processed in the manner described before.

In this composition, approximately 9 weight percent of the total weight percentage of molybdenum is used to eliminate the free carbon present in the starting mixture, resulting in an effective gross composition of the input carbonitride of $(Ti_{.926}Mo_{.074})(C_{.935}N_{.065})_{.93}$. The gross composition of the carbonitride is further shifted towards the molybdenum side by reaction with the molybdenum in the binder during sintering.

After processing of the powder mixture as described before, the pressed compacts were sintered for 1 hour and 40 minutes at 1410°C under vacuum. The sintered compacts had a Rockwell A hardness of 92.9 and a bending strength of 174 kpsi.

EXAMPLE 4

A powder blend consisting of 82.3 weight percent of a carbonitride alloy $(Ti_{.70}Mo_{.30})(C_{.88}N_{.12})_{.96}$, 14 weight percent nickel, and 3.70 weight percent molybdenum was processed as described before and sintered for 1 hour and 40 minutes at 1425°C under vacuum. The measured Rockwell A hardness of the sintered compact was 93.0 and the bending strength 225 kpsi.

EXAMPLE 5

A powder blend consisting of 81.6 weight percent of a carbonitride alloy $(Ti_{.83}Mo_{.17})(C_{.87}N_{.13})_{.92}$, 17.5 weight percent cobalt, and 0.90 weight percent molybdenum was processed as described before and sintered for 1 hour and 15 minutes at 1445°C under vacuum. The measured Rockwell A hardness of the sintered compact was 92.6 and the bending strength 196 kpsi.

EXAMPLE 6

A powder blend consisting of 81 weight percent $(Ti_{.83}W_{.17})(C_{.88}N_{.12})_{.91}$, 11 weight percent nickel and 6 weight percent tungsten was processed in the manner described before and sintered for 1 hour and 50 minutes at 1416°C under high vacuum. The sintered compacts had a Rockwell A hardness of 93.1 and a bending strength of 195 kpsi.

EXAMPLE 7

A powder blend consisting of 86.25 weight percent of a carbonitride alloy $(Ti_{.75}W_{.25})(C_{.89}N_{.11})_{.98}$, 11 weight percent nickel, and 2.27 weight percent molybdenum was processed in the manner described before and sintered for 1 hour and 35 minutes at 1415°C under vacuum. The Rockwell A hardness of the sintered composite was 93.1 and the bending strength 203 kpsi.

EXAMPLE 8

A powder blend consisting of 86.25 weight percent of a carbonitride alloy $(Ti_{.80}Mo_{.20})(C_{.70}N_{.30})_{.95}$, 11 weight percent nickel, and 2.75 weight percent molybdenum was processed in the manner described before and sintered for 2 hours at 1490°C under vacuum. The Rockwell A hardness of the composite was 93.4 and the bending strength 155 kpsi.

Test results and performance data from these examples, as well as from other tools in accordance with the invention and selected prior art tools, when all were subjected to the test conditions described above, are given in the following Tables 1 through 5 and FIGS. 8, 9, 10 and 11.

Table 1

Wear Pattern of the Tools described in Examples 1 through 8 in Comparison to Commercial Sintered Carbides. Test Condition A. Hardness of 4340 steel: $R_c$ 16 to 19.

| Tool | Total Cutting Time, Min. | Notch Due to Crater Breakout | Wear Pattern: Corner Wear | Flank Wear | Notch at Scale Line | Crater Depth | Edge Deform. | Remarks |
|---|---|---|---|---|---|---|---|---|
| Example 1 | 20.32 | <.0015" | .006" | .009" | <.0015" | .0022" | <.0003" | — |
| Example 2 | 27.71 | .001" | .010" | .012" | .002" | .0036" | .001" | — |
| Example 3 | 19.13 | .002" | .009" | .010" | .003" | .0026" | .001" | — |
| Example 4 | 12.30 | .002" | .012" | .014" | .004" | .0038" | .0016" | deformation |
| Example 5 | 3.40 | .001" | .009" | .008" | .002" | .0017" | .0023" | deformation |
| Example 6 | 15.87 | .001" | .004" | .009" | .002" | .0017" | <.0003" | — |
| Example 7 | 12.05 | .001" | .011" | .012" | .003" | .0028" | .0006" | — |
| Example 8 | 21.03 | .003" | .007" | .013" | .008" | .0023" | .0004" | notch at D |
| TiC—Mo—Ni | 21.28 | .003" | .008"+ | .012" | .009" | .0026" | .0008" | notch at D |
| TiC—Mo—Ni(R) | 1.50 | .002" | .018" | .007" | .002" | — | .003" | heavy deform. |
| C-7 | 6.39 | .008" | .008"+ | .014" | .013" | .0075" | <.0003" | chip at A |

Table 2

Wear Pattern of the Tools Described in the Examples in Comparison to Commercial Sintered Carbides. Test Condition B. Hardness of 4340 steel: $R_c$ 31 to 33

| Tool | Total Cutting Time, Min. | Notch Due to Crater Breakout | Wear Pattern: Corner Wear | Flank Wear | Notch at Scale Line | Crater Depth | Edge Deform. | Remarks |
|---|---|---|---|---|---|---|---|---|
| Example 1 | 16.79 | — | .005" | .006" | .002" | .0014 | <.0003" | — |
| Example 2 | 10.70 | — | .010" | .008" | .001 | .002" | .002" | deformation |
| Example 3 | 11.15 | — | .007" | .011" | .004" | .0014" | .0008" | — |
| Tool A (*) | 13.27 | — | .005"+ | .006" | .002" | .0016" | .0006" | — |
| TiC—Mo—Ni | 10.95 | .002" | .008" | .010" | .030×.024" | .0017 | .0015" | chipped at D |

(*) Tool A: 88.5 wt% $(Ti_{.92}Mo_{.08})(C_{.91}N_{.09})_{1.01}$, 12.5 wt% Ni, 9 wt% Mo Table 3

Wear Pattern of the Tools Described in the Examples in Comparison to Commercial Sintered Carbides. Test Condition C.

| Tool | Total Cutting Time, Min. | Notch Due to Crater Breakout | Wear Pattern: Corner Wear | Flank Wear | Notch at Scale Line | Crater Depth | Edge Deform. | Remarks |
|---|---|---|---|---|---|---|---|---|
| Example 1 | 10.10 | — | .002" | .003" | — | .0007" | <.0002" | — |
| Example 2 | 10.20 | — | .002" | .003" | .001" | .0007" | <.0006" | — |
| Example 4 | 12.50 | .001" | .003" | .004" | .001" | .0013" | <.0006" | — |
| Example 6 | 10.80 | .001" | .002" | .003" | — | .0007" | <.0003" | — |
| Tool B(*) | 9.05 | — | .003"+ | .002" | — | .001" | .0012" | deformation |
| Tool C(*) | 1.64 | — | .018" | .008" | — | — | .004" | heavy corner deformation |
| TiC—Mo—Ni(1) | 4.68 | — | .010" | .008" | .026" | .0017" | .0028" | chipping at D |
| TiC—Mo—Ni(2) | 10.20 | .002" | .005" | .003"+ | .027" | .001" | .0015" | chipping at D |
| TiC—Mo—Ni(R) | 1.69 | .002" | .016" | .008" | .004" | — | .004" | heavy corner deformation |
| C-7 | 9.82 | .020" | .008" | .006" | .014" | .0052 | <.0003" | chipping at A and D |

(*)Tool B: 78 wt% $(Ti_{.82}Mo_{.18})(C_{.87}N_{.13})_{.92}$, 17.5 wt% Ni, 4.5 wt% Mo
Tool C: 68.5 wt% $(Ti_{.82}Mo_{.18})(C_{.87}N_{.13})_{.92}$, 25 wt% Ni, 6.5 wt% Mo Table 4

Wear Pattern of the Tools described in the Examples in Comparison to Commercial Sintered Carbides. Test Condition D.

| Tool | Total Cutting Time, Min. | Notch Due to Crater Breakout | Corner Wear | Flank Wear | Notch at Scale Line | Edge Deform. | Remarks |
|---|---|---|---|---|---|---|---|
| Example 1 | 4.36 | — | .005" | .004" | .002" | .0012" | even wear |
| Example 3 | .86 | — | .008" | .006" | .005" | .0014" | noticeable deform. |
| Tool A(*) | 5.15 | — | .010" | .009" | .008" | .0020" | noticeable deform. |
| TiC—Mo—Ni(1) | .66 | | | .120" | | | edge broke |
| TiC—Mo—Ni(1) | .63 | — | .016" | .012" | .008" | .0035" | cracked edge |

Table 4-continued

Wear Pattern of the Tools described in the Examples in Comparison to Commercial Sintered Carbides. Test Condition D.

| Tool | Total Cutting Time, Min. | Notch Due to Crater Breakout | Corner Wear | Flank Wear | Notch at Scale Line | Edge Deform. | Remarks |
|---|---|---|---|---|---|---|---|
| TiC—Mo—Ni(1) | 1.06 | | | .100" | | | edge broke |
| TiC—Mo—Ni(2) | .28 | — | .006" | .007" | .008" | .0020" | deformation |
| cont'd | .83 | — | .008" | .010" | .016" | .0026" | deform., notch at D |
| TiC—Mo—Ni(R) | .12 | | | .100" | | | edge broke |

(*)Tool A: 88.5 wt% $(Ti_{.92}Mo_{.08})(C_{.91}N_{.09})_{1.01}$, 12.5 wt% Ni, 9 wt% Mo Table 5

Edge Breakdown Points of Tool Described in the Examples in Comparison to Commercial Sintered Carbides. Test Condition E.

| Tool | Feed Rate at Edge Breakdown Point | Thermal deformation in pass prior to breakdown | Remarks |
|---|---|---|---|
| Example 1 | .0563 ipr(*) | .0028" | Edge broke at lathe stall |
| Example 2 | .0406 ipr | .0033" | — |
| Example 3 | .0457 ipr | .003" | — |
| TiC—Mo—Ni (1) | .0304 ipr | .0031" | — |
| TiC—Mo—Ni (2) | .0406 ipr | .003" | — |

(*)Inch per revolution

FIG. 8 shows the averaged corner and flank wear as a function of the cutting time for tools formed from the above Examples 1 and 6 and the prior art carbide tools TiC-Mo-Ni, TiC-Mo-Ni (R) and a C-7 grade cemented carbide when subjected to test condition A.

FIG. 9 shows the averaged corner and flank wear as a function of the cutting time for tools from the above Example 1, for another tool A formed from 88.5 weight percent $(Ti_{.93}Mo_{.08})$ $(C_{.92}Mo_{.08})_{1.01}$, 12.5 weight percent nickel, and 9 weight percent molybdenum, and the prior art carbide tool TiC-Mo-Ni when subjected to test condition B.

FIG. 10 shows the averaged corner and flank wear as a function of the cutting time for tools formed from the above Example 2, for another tool B formed from 78 weight percent $(Ti_{.82}Mo_{.18})$ $(C_{.87}N_{13})_{.92}$, 17.5 weight percent nickel, and 4.5 weight percent molybdenum, and the prior art carbide tools TiC-Mo-Ni (1), TiC-Mo-Ni (2), TiC-Mo-Ni (R), and a C-7 grade cemented carbide when subjected to test condition C.

It is seen from the curves of FIGS. 8 through 10 and Tables 1 through 5 that the tools of the invention have superior thermal deformation and chipping resistance, at equal or better wear resistance, when compared to the best prior art carbide tools in high speed cutting of annealed 4340 steel. The better thermal deformation and stength characteristics are particularly noticeable when cutting hardened 4340 steel, test condition B, or in roughing cuts, test condition C.

The following Table 6 shows the wear rate of a large number of tools formed from specific compositions in accordance with the present invention when subjected to test condition A. When examining the data given for the tool alloys in Table 6, it will be appreciated that many tool compositions showing extensive thermal deformation at the high cutting speeds of test condition A but also that, because of their higher strength and toughness, the same tools may show superior performance in roughing cuts at lower cutting speeds and in machining lower strength steels and thus be of practical usefulness. Table 7 lists the gross compositions of the carbonitrides used in the preparation of the tool alloys in Table 6.

Table 6

| Input Carbo-nitride | Binder weight percent | $t_f^{(=)}$ | $t_r^{(==)}$ | $Def^{(===)}$ | Remarks |
|---|---|---|---|---|---|
| A | 13Ni, 17.85Mo | 16 | 9.5 | .0004" | — |
| A | 10Ni, 18.35Mo | 22 | 9 | <.0003" | — |
| B | 13.9Ni, 8.72Mo | 18 | 10.5 | <.0002" | — |
| C | 25Ni, 8.75Mo | — | — | — | deformation |
| D | 14Ni | 16 | 9 | .0003" | — |
| E | 10Ni, 6Mo | 22 | 10 | .0003" | — |
| F | 12Ni, 9.52Mo | 13 | 7 | .0004" | — |
| G | 13Ni, 3.5Mo | 16 | 8 | .0002" | — |
| G | 16Ni, 4Mo | 3 | 4 | .0015" | deformation |
| H | 9.5Ni, 2.5Mo | 12 | 8 | .0003" | — |
| I | 10.0Ni, 2.5Mo | 9 | 5 | .0004" | — |
| C | 13Ni, 6W | 22 | 10 | <.0003" | — |
| C | 15Ni, 8W | 16 | 9 | .0004" | — |
| C | 13Ni, 3 Cr | 20 | 9 | .0005" | — |
| C | 16Ni, 5 Cr | 10 | 7 | .0008" | — |
| C | 15Co, .75Mo | 15 | 9 | .0006" | — |
| C | 15Co, 1.50Mo | 17 | 9 | .0004" | — |
| C | 15Co, 4W | 15 | 9 | .0003" | — |
| F | 13Co, 4Mo | 20 | 10 | .0003" | — |

Table 6-continued

| Input Carbo-nitride | Binder weight percent | $t_f$ (*) | $t_c$ (**) | Def (***) | Remarks |
|---|---|---|---|---|---|
| C | 6.5Ni, 6.5Co, 3.5Mo | 21 | 10 | <.0003" | — |
| C | 7.5Ni, 7.5Co, 3.5 Mo | 15 | 8 | .0008" | — |
| C | 7.5Ni, 7.5Co, 6W | 13 | 7 | .001" | — |
| C | 10Fe, 2.5Mo | — | — | — | brittle, severe chipping |
| C | 15Fe | 16 | 8 | .0003" | slight chipping |
| A | 15Fe, 5Mo | 14 | 7 | .0015" | deformation |
| C | 10Ni, 3Fe, 2Mo. | 21 | 10 | <.0003" | — |
| C | 12Co, 2Fe, 7.5Mo | 20 | 9 | .0004" | — |
| A | 10-UDIMET 700, 6Mo | 16 | 10 | <.0002" | slight chipping |
| C | 10-UDIMET 700 | 18 | 9 | .0005" | slight chipping |
| J | 11 Ni, 7Mo | 13 | 9 | .0007" | — |
| J | 11 Ni, 14W | 1 | — | >.005" | heavy thermal deform. |
| J | 11 Co, 8W | 2 | — | .004" | heavy thermal deform |
| J | 9.3Ni, 20W | 16 | 9 | .0008" | — |
| K | 9.5Ni, 6Mo | 22 | 11 | <.0003" | — |
| M | 9 Ni, 35W | — | — | — | deformation excess W |
| M | 12 Co, 9Mo | 12 | 7 | .0008" | — |
| M | 8.5Ni, 6W | 14 | 8 | <.0003" | — |
| L | 8.5Ni, 5W | 17 | 11 | <.0003" | — |
| L | 10.5Ni | 18 | 10 | <.0003" | — |
| L | 12Ni | 20 | 10 | .0004" | — |
| L | 12Ni, 3Mo | 18 | 11 | <.0002" | — |
| N | 11Ni, 2.6Mo | 11 | 7 | .0003" | — |
| N | 8.8Ni | 16 | 8 | <.0003" | — |
| O | 9.7Ni | 7 | 4 | .0004" | sec.phase WC |
| O | 9.7Ni, 2.4Mo | 10 | 4 | <.0003" | —"— |
| K | 13 Fe | 4 | — | — | chipping |
| L | 17 Fe | — | — | — | deformation + chipp. |
| K | 7.5Ni, 2Fe, 4Mo | 20 | 10 | <.0003" | — |
| L | 8 Co, 3Fe | 19 | 10 | .0004" | — |
| K | 11Co, 3Cr | 14 | 7 | .0003" | — |
| L | 10Ni, 2.5 Cr | 20 | 9 | <.0003" | — |
| K | 11-UDIMET 700, 2Mo | 18 | 9 | <.0003" | — |
| L | 10-UDIMET 700, 5Mo | 8 | 8 | n.d. | chipping |
| P | 12Ni | 20 | 10 | .0004" | — |
| P | 12Ni, 2Mo | 21 | 11 | <.0003" | — |
| P | 12Ni, 4W | 19 | 10 | .0003" | — |
| Q | 13Ni, 2.5 Mo | 22 | 11 | <.0003" | — |
| C+L,2:1 | 13Ni, 2.5Mo | 22 | 11 | <.0003" | — |
| Q | 12Co | 18 | 10 | .0003" | — |

(*)Minutes cutting time to reach .010" flank wear
(**)Minutes cutting time to reach .002" crater depth
(***)Edge or corner deformation after 5 minutes cutting time. Wear data are for Test Condition A Table 7

Gross Compositions of the Input Carbonitride Phase for the Tools Listed in Table 6

| Designation | Composition of Carbonitride | Method of Preparation |
|---|---|---|
| A | $Ti(C_{.93}N_{.07})_{1.07}$ | 1 |
| B | $(Ti_{.92}Mo_{.08})(C_{.91}N_{.09})_{1.01}$ | 1 |
| C | $(Ti_{.82}Mo_{.18})(C_{.86}N_{.14})_{.93}$ | 1 |
| D | $(Ti_{.75}Mo_{.25})(C_{.85}N_{.15})_{.89}$ | 1 |
| E | $(Ti_{.88}Mo_{.12})(C_{.88}N_{.12})_{.98}$ | 1 |
| F | $(Ti_{.75}Mo_{.25})(C_{.89}N_{.11})_{.98}$ | 1 |
| G | $(Ti_{.70}Mo_{.30})(C_{.88}N_{.12})_{.96}$ | 1 |
| H | $(Ti_{.70}Mo_{.30})(C_{.80}N_{.20})_{.92}$ | 2 |
| I | $(Ti_{.50}Mo_{.50})(C_{.90}N_{.10})_{.87}$ | 2 |
| J | $(Ti_{.92}W_{.08})(C_{.91}N_{.09})_{1.01}$ | 1 |
| K | $(Ti_{.88}W_{.12})(C_{.90}N_{.10})_{.98}$ | 1 |
| L | $(Ti_{.83}W_{.17})(C_{.88}N_{.12})_{.92}$ | 1 |
| M | $(Ti_{.86}W_{.14})(C_{.91}N_{.09})_{1.02}$ | 1 |
| N | $(Ti_{.75}W_{.25})(C_{.89}N_{.11})_{.97}$ | 1 |
| O | $(Ti_{.65}W_{.35})(C_{.88}N_{.12})_{.94}$ | 1 |
| P | $(Ti_{.80}Mo_{.10}W_{.10})(C_{.86}N_{.14})_{.92}$ | 1 |
| Q | $(Ti_{.80}Mo_{.15}W_{.05})(C_{.87}N_{.13})_{.91}$ | 1 |

The compositions of the present invention are formed from the above described carbonitrides with a binder selected from metals of the iron group, such as nickel, cobalt and iron, and metals from the group of certain refractory transition metals, such as chromium, molybdenum, and tungsten. The binder alloy may also contain smaller alloying additions, such as aluminum and titanium, which are known to strengthen such ferrous metal alloys. The binder content of the composites of the invention can vary from 5 to 45 percent by weight of the composition. If too little binder is used, the composition will be too brittle, if too much binder is used, the composition will be too soft and will deform. When used as a cutting tool, the binder contents are preferably between 8 to 25 percent by weight of the composition.

The selection of the proper binder alloy is additionally dependent upon the composition of the carbonitride phase and the desired characterisitics of the sintered compacts.

In terms of wear performance, tools and nickel-and cobalt-base binders proved equivalent, although the bending strengths of nickel alloy-bonded tools generally were observed to be somewhat higher. The use of iron-base alloys are binders for composites intended for tool applications is limited to compositions containing high binder contents (greater than 15 weight percent) because of embrittlement at lower concentrations. Low level alloying additions of iron to nickel- and cobalt-base binders improved binder wetting, but did not affect bending strength of the composite. Binder alloys containing nickel and cobalt in different proportions resulted in composites with lower hardness and better toughness qualities, but the thermal deformation tendency was usually greater than of tools based on either nickel or cobalt-base binders.

Alloying additions to the iron metal base binders, preferably nickel and cobalt, play an important role in determining strength and thermal deformation characteristics of the sintered composites of the invention. Thus, for example, molybdenum contents between 20 and 25 percent by weight of the nickel will optimize the bending strength of composites fabricated from the carbonitride composition $(Ti_{.82}Mo_{.18})(C_{.87}N_{.13})_{.92}$, as shown by the graphs in FIG. 11. For the same carbonitride alloy, but using cobalt as the binder phase, the corresponding figure is about 10 percent by weight of the cobalt. No molybdenum additions are recommended when an iron base binder is used. The optimum percentage figure for molybdenum additions to the binder phase are also a function of the carbonitride stoichiometry and, to a smaller degree, also of the sintering conditions. The molybdenum additions required generally increase with increasing value of the stoichiometry parameter $z$ in the carbonitride and with increasing sintering temperatures.

Tungsten additions to the binder phase have a similar effect as molybdenum additions and particularly improve binder wetting and binder distribution. At optimum tungsten levels the bending strengths were only marginally lower than those obtained with molybdenum additions and wear performance was also about equivalent.

Chromium additions by employing binder alloys based on Ni-Cr, Co-Cr, Fe-Cr, and super alloy binders, such as UDIMET 700, somewhat impaired cutting performance through noticeable embrittlement of sintered composites at lower binder levels (less than 14 percent by weight), but the improved oxidation resistance should make such composites of interest in other applications.

The properties of the carbonitride-binder metal composites of the invention can further be extensively modified by alloying of the carbonitride phase. The following summary of the effects of the principal alloying ingredients are based on observation of their fabrication characteristics, measured properties, and on performance studies of the composites as tool materials in turning 4340 steel. However, low level alloying with other elements may also be accomplished without departing from the spirit of the invention.

1. As a generalization, for a given amount of titanium in the composition, molybdenum and tungsten can be exchanged with each other in all proportions without affecting performance and fabrication characteristics. However, those compositions which have a higher molybdenum or tungsten exchange from titanium should have a greater ratio of molybdenum to tungsten. This is particularly true as this exchange approaches or exceeds 40%, which is to say as the parameter y in $(Ti_xM_y)(C_uN_v)_z$ approaches or exceeds 0.40. For compositions falling within the composition area BCD of FIG. 1, the atomic percent of molybdenum must exceed the atomic percent of tungsten.
2. Molybdenum and/or tungsten can be exchanged for titanium of up to 22 mole percent of the titanium in the carbonitride without affecting cratering resistance, while significantly improving strength and thermal deformation resistance of the sintered composites. At molybdenum and tungsten exchanges higher than 25 mole percent, crater resistance of the tools decreases rapidly, but tool performance in cutting fully hardened low alloy steels ($R_c > 50$) is better than of the titanium-richer compositions.

The cratering behavior of tools fabricated from carbonitrides with different group VI metal exchanges is shown in FIG. 12. The crater wear rate data depicted were obtained by cutting 4340 steel with a Rockwell C hardness of 21 to 23.5 under test condition A. Because cratering in machining partially, or fully, hardened low alloy steels is of lesser importance in determining tool performance, the higher edge strength of molybdenum-or tungsten-rich tool compositions accounts for their better performance on hardened steel.

3. Low level (less than 10 atomic percent) substitution of titanium by zirconium and hafnium do not affect fabricability and performance of the tools, while exchanges of more than 20 mole percent necessitate substantially increased sintering temperatures to achieve full density. Significant additions of these elements cause uneven binder distribution and lower bending strengths of the sintered composites.
4. Partial replacement of titanium by vanadium and niobium improves wetting and lowers the sintering temperatures, but slightly impairs crater wear resistance of the tools. Tool compositions in which more than 30 mole percent of the total titanium content is replaced by these metals have to be sintered under partial nitrogen atmosphere to avoid significant compositional changes due to nitrogen losses.
5. Additions of vanadium, niobium, tantalum and chromium in replacement for molybdenum and tungsten in the carbonitride lower the nitrogen decomposition pressure and improve crater wear, but do not increase bending strength of the sintered composites. Replacement of more than 40 mole percent of the total amount of molybdenum and tungsten by these elements cause a significant narrowing of the miscibility gap and, as a consequence, loss of grain growth stability of the composite.

The following Table 8 shows the wear rates for a number of tools formed from compositions incorporating some of the alloy substitutions just discussed when these tools were subjected to Test Condition A.

Table 8

Selected List of Tool Compositions and Machining Performance Data for Alloyed Carbonitrides

| Gross Composition of Carbonitride | Binder, wt% | $t_f$ (1) | $t_c$ (2) | Def. (3) | Remarks |
|---|---|---|---|---|---|
| $(Ti_{.76}Zr_{.06}Mo_{.18})(C_{.85}N_{.15})_{.94}$ | 13 Ni, 3 Mo | 22 | 11 | <.0003" | -- |
| $(Ti_{.60}Zr_{.22}Mo_{.18})(C_{.84}N_{.16})_{.94}$ | 13 Ni, 3 Mo | — | — | — | not dense |
| $(Ti_{.76}Hf_{.06}Mo_{.18})(C_{.86}N_{.14})_{.93}$ | 13 Ni, 3 Mo | 21 | 10.5 | <.0003" | — |
| $(Ti_{.57}Hf_{.25}Mo_{.18})(C_{.88}N_{.12})_{.96}$ | 12 Ni, 3 Mo | 8 | 10 | <.0003" | chipping, tool not dense |
| $(Ti_{.80}HF_{.05}Mo_{.15})(C_{.80}N_{.20})_{.92}$ | 12 Ni, 4 Mo | 14 | 8 | .0008" | — |
| $(Ti_{.80}Hf_{.05}Mo_{.15})(C_{.80}N_{.20})_{.92}$ | 12 Co, 1 Mo | 8 | 8 | .001" | deformation |
| $(Ti_{.75}V_{.07}Mo_{.18})(C_{.87}N_{.13})_{.93}$ | 13 Ni, 3 Mo | 20 | 10 | <.0003" | -- |
| $(Ti_{.62}V_{.20}Mo_{.18})(C_{.91}N_{.09})_{.96}$ | 13 Ni, 3 Mo | 14 | 9 | <.0003" | — |
| $(Ti_{.42}V_{.40}Mo_{.18})(C_{.92}N_{.08})_{.88}$ | 13 Ni, 2 Mo | 9 | 8 | .0006" | coarse grain |
| $(Ti_{.72}V_{.10}Mo_{.18})(C_{.80}N_{.20})_{.93}$ | 13 Ni, 2 Mo | 19 | 10 | .0004" | -- |
| $(Ti_{.75}Nb_{.07}Mo_{.18})(C_{.84}N_{.16})_{.94}$ | 13 Ni, 3 Mo | 20 | 10 | <.0003" | -- |
| $(Ti_{.62}Nb_{.20}Mo_{.18})(C_{.82}N_{.18})_{.92}$ | 13 Ni, 3 Mo | 8 | n.d. | .001" | deformation |
| $(Ti_{.75}Nb_{.07}Mo_{.18})(C_{.86}N_{.14})_{.94}$ | 13 Ni, 3 Mo | 18 | 9 | <.0003" | — |
| $(Ti_{.75}Nb_{.08}W_{.17})(C_{.84}N_{.16})_{.92}$ | 11 Ni | 16 | 9 | .0004" | — |
| $(Ti_{.57}Hf_{.25}Mo_{.18})(C_{.88}N_{.12})_{.96}$ | 15 Fe | — | — | — | not dense |
| $(Ti_{.75}V_{.08}W_{.17})(C_{.85}N_{.15})_{.93}$ | 11 Ni | 16 | 10 | <.0003" | — |
| $(Ti_{.80}V_{.05}Mo_{.15})(C_{.84}N_{.16})_{.95}$ | 12 Ni, 4 Mo | 20 | 11 | <.0003" | -- |
| $(Ti_{.80}V_{.10}Mo_{.10})(C_{.82}N_{.18})_{.95}$ | 12 Ni, 4 Mo | 17 | 10 | <.0003" | -- |
| $(Ti_{.70}V_{.15}Mo_{.15})(C_{.79}N_{.21})_{.93}$ | 12 Ni, 3 Mo | 18 | 10 | .0006" | -- |
| $(Ti_{.80}V_{.05}Mo_{.15})(C_{.84}N_{.16})_{.95}$ | 12 Co, 1 Mo | 16 | 10 | <.0003" | -- |
| $(Ti_{.80}V_{.05}Mo_{.15})(C_{.84}N_{.16})_{.95}$ | 6 Ni, 6 Co, 2 Mo. | 18 | 10 | .0004" | — |
| $(Ti_{.80}Nb_{.05}Mo_{.15})(C_{.85}N_{.15})_{.94}$ | 12 Ni, 3 Mo | 21 | 10 | <.0003" | — |
| $(Ti_{.70}Nb_{.15}Mo_{.15})(C_{.81}N_{.19})_{.92}$ | 12 Ni, 3 Mo | 14 | 8 | .0004" | — |
| $(Ti_{.80}Ta_{.05}Mo_{.15})(C_{.86}N_{.14})_{.91}$ | 12 Ni, 3 Mo | 19 | 9 | <.0003" | — |
| $(Ti_{.70}Ta_{.15}Mo_{.15})(C_{.82}N_{.18})_{.92}$ | 11 Ni, 2 Mo | 8 | 9 | .0004" | nitrogen loss |
| $(Ti_{.80}Cr_{.05}Mo_{.15})(C_{.86}N_{.14})_{.92}$ | 12 Ni, 3 Mo | 19 | 9 | < .0003" | — |
| $(Ti_{.70}Cr_{.15}Mo_{.15})(C_{.85}N_{.15})_{.93}$ | 13 Ni, 4 Cr | 14 | 9 | — | chipping |
| $(Ti_{.70}Cr_{.15}Mo_{.15})(C_{.85}Ni_{.15})_{.93}$ | 11-UDIMET 700 | 12 | 9 | .0004" | — |
| $(Ti_{.80}Cr_{.05}Mo_{.15})(C_{.86}N_{.14})_{.92}$ | 12 Co, 2 Cr | 17 | 9 | .0004" | — |

(1) Minutes cutting time to reach .010" flank wear
(2) Minutes cutting time to reach .002" crater depth
(3) Edge or corner deformation after 5 minutes cutting time. Wear data are for Test Condition A The data shown in the above discussed tables and graphs are representative of many other alloys within the range of the invention which were prepared and tested. It becomes evident from a comparison of the performance data that the new spinodal carbonitride-metal composites of the invention afford a substantial improvement in terms of tool reliablility and performance of cemented carbides of the state of the art designed for similar applications.

Although each machining operation has its particular requirements which may favor use of a particular tool grade in place of another, our extensive machinability tests have indicated, that tool alloys based on the alloy system Ti-Mo-C-N, with binder alloys based on Ni-Mo, show the greatest versatility and range of application for commonly practiced machining operations. Among the compositions within the confines of this particular base system, the alloys including carbonitride compositions $(Ti_xMo_y)(C_uN_v)_z$, in which y and v may vary between 0.10 and 0.20, and $z$ between 85 and 1.07, and with Ni-Mo binders between 12 and 20 percent by weight of the sintered composition, is indicated to offer a good compromise between range of application, toughness and strength properties, performance, ease of manufacture, and cost.

While the principal application of the new spindal carbonitride composites of the invention is envisioned to be in the area of machine tools, their high wear resistance will make them also suitable for applications where currently tungsten carbide-based, cemented carbides are used, such as wear-resistant linings, gage blocks, bearings, wear-resistant seals, etc.

While the invention is thus disclosed and many specific embodiments described in detail, it is not intended that the invention be limited to those shown embodiments. Instead, many modifications will occur to those skilled in the art which fall within the spirit and scope of the invention. It is intended that the invention be limited only by the appended claims.

What is claimed is:

1. A composition of material comprising sintered carbonitride-binder metal alloys in which the carbonitride has the formula $(Ti_xM_y)(C_uN_v)_z$, where M is a Group VI metal, with $x + y = 1$, $u + v = 1$, and $0.80 \leq z \leq 1.07$, and where the value of $y$ is from 0.04 to 0.40 and the range of the value of $v$ is a function of $y$, with the upper limit of the value of $v$ as a function of $y$ being defined by the line ED of FIG. 1 and the lower limit of the value of $v$ as a function of $y$ being defined by the line AB of FIG. 1, in which the binder is selected from metals of the iron group and metals of the group VI refractory transition metals and comprises between 5 and 45 weight percent of the composition, and in which the carbonitride component of the alloy is a two phase mixture comprising a titanium and nitrogen-rich carbonitride solid solution, and another hard phase which is rich in the group VI metal components and poor in nitrogen, and the two-phase mixture forming a microstructure in which the titanium and nitrogen-rich carbonitride phase is surrounded by the phase rich in group VI metals but poor in nitrogen and forms the main interface with the binder alloy.

2. A composition of material according to claim 1 in which said group VI metal M is selected from the group consisting of molybdenum and tungsten.

3. A composition of material according to claim 2 in which the value of $y$ is from 0.04 to 0.30 and the range of the value of $v$ is a function of $y$, with the upper limit of the value of $v$ as a function of $y$ being defined by the lines E′ D′ and D′ C′ of FIG. 1 and the lower limit of the value of $v$ is a function of $y$ being defined by the line A B′ of FIG. 1.

4. A composition of material according to claim 1 in which said iron metal in the binder is selected from the group consisting of cobalt and nickel and comprises between 8 and 25 weight percent of the composition.

5. A composition of material according to claim 1 in which said group VI metal in the binder is selected from the group consisting of chromium, molybdenum, and tungsten and comprises between 1 and 12 weight percent of the composition.

6. A composition of material according to claim 1 in which up to 20 mole percent of the total amount of titanium in said carbonitride is replaced by a metal chosen from the group consisting of zirconium, hafnium, vanadium and niobium.

7. A composition of material according to claim 1 in which up to 40 mole percent of the total amount of group VI metal in said carbonitride is replaced by a metal selected from the group consisting of vanadium, niobium, tantalum and chromium.

8. A composition of material according to claim 1 in which up to 40 weight percent of the binder is iron and the balance of the binder is selected from the group consisting of cobalt and nickel.

9. A composition of material according to claim 8 in which the binder comprises between 8 and 25 weight percent of the composition.

10. A composition of material according to claim 3 in which said group VI metal M is selected from the group consisting of molybdenum and tungsten.

11. A composition of material according to claim 10 in which said iron metal in the binder is selected from the group consisting of cobalt and nickel and comprises between 8 and 25 weight percent of the composition.

12. A composition of material according to claim 1 in which said binder contains between 0.2 and 8 weight percent titanium and between 0.2 and 4 weight percent aluminum.

13. The method of forming a composition of material comprising sintered carbonitride-binder metal alloys, in which the carbonitride has the formula $(Ti_xM_y)(C_uN_v)_z$, where M is a group VI metal, with $x + y = 1$, $u + v = 1$, and $0.80 \leq z \leq 1.07$, and where the value of $y$ is from 0.04 to 0.40 and the range of the value of $v$ is a function of $y$, with the upper limit of the value of $v$ as a function of $y$ being defind by the line ED of FIG. 1 and the lower limit of the vaue of $v$ as a function of $y$ being defined by the line AB of FIG. 1, and in which the carbonitride component of the alloy is a two-phase mixture comprising a titanium and nitrogen-rich carbonitide solid solution, and another hard phase which is rich in the group VI metal components and poor in nitrogen, and the two-phase mixture forming a microstructure in which the titanium and nitrogen-rich carbonitride phase is surrounded by the phase rich in group VI metals but poor in nitrogen and forms the main interface with the binder alloy, comprising the steps of:

forming carbonitride alloy powders by reacting mixtures of metal and metal carbide powders with niteogen gas at temperatures between 1400° and 1800°C to form a homogeneous solution at these temperatures;

cooling the carbonitride alloy powder to cause it to decompose into a two-phase mixture comprising a titanium and nitrogen-rich carbonitride solid solution, and another hard phase which is rich in the group VI metal components and poor in nitrogen, with the two-phase mixture forming a microstructure in which the titanium and nitrogen-rich carbonitride phase is surrounded by the phase rich in group VI metals but poor in nitrogen;

adding binder material to the mixture;

mechanically milling the mixture under inert fluids until it has uniform consistency and the desired grain size;

compacting the mixture into a desired shape; and sintering the compacts so formed at an elevated temperature.

14. The method of claim 13 which further comprises the step of grinding the sintered compact into a predetermined shape to form a metal cutting tool.

* * * * *

Disclaimer 3,971,656.—*Erwin Rudy,* Beaverton, Oreg. SPINODAL CARBONITRIDE ALLOYS FOR TOOL AND WEAR APPLICATIONS. Patent dated July 27, 1976. Disclaimer filed June 22, 1982, by the assignee, *Teledyne Industries, Inc.*

The term of this patent subsequent to Oct. 8, 1991, has been disclaimed.

[*Official Gazette March 15, 1983.*]